US008976088B2

(12) United States Patent
Han et al.

(10) Patent No.: US 8,976,088 B2
(45) **Date of Patent: *Mar. 10, 2015**

(54) PIXEL AND ORGANIC LIGHT EMITTING DISPLAY DEVICE USING THE SAME

(75) Inventors: Sam-Il Han, Yongin (KR); Ki-Myeong Eom, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 435 days.

This patent is subject to a terminal disclaimer.

(21) Appl. No.: 12/964,435

(22) Filed: Dec. 9, 2010

(65) Prior Publication Data

US 2011/0141000 A1 Jun. 16, 2011

(30) Foreign Application Priority Data

Dec. 10, 2009 (KR) ..... 10-2009-0122490

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2320/0223* (2013.01); *G09G 2320/0233* (2013.01); *G09G 2320/043* (2013.01)
USPC ..... 345/76

(58) Field of Classification Search
USPC ..... 345/76–83; 315/169.1–169.4
See application file for complete search history.

(56) References Cited

U.S. PATENT DOCUMENTS

| | | | | |
|---|---|---|---|---|
| 2006/0125737 | A1* | 6/2006 | Kwak et al. | 345/76 |
| 2008/0211747 | A1* | 9/2008 | Kim | 345/76 |
| 2008/0211796 | A1* | 9/2008 | Kim | 345/204 |
| 2008/0224965 | A1* | 9/2008 | Kim | 345/76 |
| 2009/0174699 | A1 | 7/2009 | Fish et al. | |

FOREIGN PATENT DOCUMENTS

| | | | |
|---|---|---|---|
| KR | 10-2006-0023672 | A | 3/2006 |
| KR | 10-2006-0064194 | A | 6/2006 |
| KR | 10-2006-0112983 | A | 11/2006 |
| KR | 10-0901778 | B1 | 6/2009 |

OTHER PUBLICATIONS

Korean Office Action dated Jan. 19, 2012 for Korean Patent Application No. KR 10-2009-0122490 which corresponds to captioned U.S. Appl. No. 12/964,435.

* cited by examiner

*Primary Examiner* — Dennis Joseph
(74) *Attorney, Agent, or Firm* — Knobbe Martens Olson & Bear LLP

(57) ABSTRACT

A pixel circuit and an organic light emitting display using the pixel circuit are disclosed. The pixel circuit compensates for variation of the threshold voltage of a driving transistor and for variation in the power supply to the pixel.

17 Claims, 7 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0122490, filed on Dec. 10, 2009, in the Korean Intellectual Property Office, the entire content of which is incorporated herein by reference.

BACKGROUND

1. Field

Embodiments relate to a pixel and an organic light emitting display device, and more specifically, to a pixel that is useful for implementing high resolution and high frequencies, and an organic light emitting display device using the pixel.

2. Description of the Related Technology

Various flat panel display devices that have advantages over cathode ray tubes, that is, the weight and size, have been developed. Flat panel display devices, liquid crystal display devices, field emission display devices, plasma display panels, and organic light emitting display devices have been proposed.

The organic light emitting display devices display images using OLEDs (organic light emitting diodes) that generate light by recombination of electrons and holes.

The field of application of such organic light emitting display devices has increasingly expanded to include PDAs, MP3 players, mobile phones, etc. due to various advantages, such as high color reproduction and a small thickness.

The organic light emitting diodes used for the organic light emitting display devices include an anode electrode, a cathode electrode, and a light emitting layer formed therebetween. The organic light emitting diode emits light, when electric current flows from the anode electrode and the cathode electrode, and the amount of emitted light changes in accordance with changes in the amount of electric current, such that luminance is controlled.

FIG. 1 is a circuit diagram illustrating a pixel employed in some light emitting display devices. Referring to FIG. 1, the pixel includes an organic light emitting diode OLED, a first transistor T1, a second transistor T2, a third transistor T3, a fourth transistor T4, a fifth transistor T5, a sixth transistor T6, and a capacitor Cst. The first to sixth transistors T1 to T6 have a gate electrode, a source electrode, and a drain electrode, and the capacitor Cst is composed of a first electrode and a second electrode.

Regarding the first transistor T1, the source electrode is connected to a first node A, the drain electrode is connected to a second node B, and the gate electrode is connected to a third node C.

Regarding the second transistor T2, the source electrode is connected to a data line Dm and the drain electrode is connected to the first node A. Further, the gate electrode is connected to a first scanning line Sn. Therefore, a data signal is transmitted to the first node A by a first scanning signal that is inputted through the first scanning line Sn.

Regarding the third transistor T3, the source electrode is connected to the second node B, the drain electrode is connected to the third node C, and the gate electrode is connected to the first scanning line Sn. The potentials of the second node B and the third node C become the same, when the third transistor T3 is turned on by the first scanning signal that is transmitted through the first scanning line.

Regarding the fourth transistor T4, the source is connected to an initialization power supply VINT, the drain electrode is connected to the third node C, and the gate electrode is connected to a second scanning line Sn−1. In this configuration, a scanning signal that is transmitted to the second scanning line Sn−1 is a scanning signal that allows a data signal to be transmitted to the pixel of the previous row.

Regarding the fifth transistor T5, the source electrode is connected to a first pixel power supply ELVDD, the drain electrode is connected to the first node A, and the gate electrode is connected to a light emitting control line En. Therefore, the first pixel power supply ELVDD is selectively supplied to the first transistor T1, in accordance with a light emitting control signal that is transmitted through the light emitting control line.

Regarding the sixth switching transistor T6, the source electrode is connected to the third node C, the drain electrode is connected to the organic light emitting diode OLED, and the gate electrode is connected to the light emitting control line En. Therefore, the electric current flowing from the source electrode of the first transistor to the drain electrode is selectively transmitted to the organic light emitting diode OLED, in accordance with the light emitting control signal that is transmitted through the light emitting control line En.

Regarding the capacitor Cst, the first electrode is connected to the first pixel power supply ELVDD and the second electrode is connected to the third node C. Therefore, when an initialization signal is transmitted to the third node C by the fourth transistor T4, the capacitor Cst stores the initialization voltage so that the third node C maintains the initialization voltage. Further, when a data signal is transmitted to the first transistor T1 by the second transistor T2 and the third transistor T3, the third node C stores voltage corresponding to the data signal.

The current in the OLED is represented by the following Formula 1:

$$I_{OLED} = \frac{\beta}{2}(Vgs - Vth)^2 = \frac{\beta}{2}(Vdata - ELVDD + Vth - Vth)^2 = \frac{\beta}{2}(Vdata - ELVDD)^2 \quad \text{[Formula 1]}$$

where $I_{OLED}$ is electric current flowing to the organic light emitting diode OLED, Vgs is voltage applied in between the gate electrode and the source electrode of the first transistor T1, EVDDD is voltage of the first pixel power supply, Vth is threshold voltage of the first transistor T1, and Vdata is voltage of a data signal.

Referring to Formula 1, the electric current flowing to the organic light emitting diode OLED by the first transistor corresponds to the voltage of the data signal and the voltage of the first pixel power ELVDD, and is independent of the threshold voltage Vth of the first transistor. Therefore, the threshold voltage is compensated.

However, since the electric current flows according to the voltage of the first pixel power ELVDD and the data signal, and the first pixel power transmitted to each pixel is different by voltage drop, uniform electric current does not flow to the pixels.

Further, when the organic light emitting display device has high resolution and receives a high-frequency driving signal, the length of one horizontal time is reduced. For example, the organic light emitting display device is driven at FHD resolution and 60 Hz, the length of one horizontal time is 14.8 μs, while it is driven at FHD resolution and 120 Hz, the length of one horizontal time decreases to 7.4 μs.

As the length of one horizontal time reduces, the time for compensating the threshold voltage reduces, such that the picture quality is deteriorated.

SUMMARY

One aspect is a pixel including an organic light emitting diode configured to emit light according to a pixel electric current flowing from a first pixel power supply to a second pixel power supply, a first transistor including a first electrode connected to the first pixel power supply, a second electrode connected to a first node, and a gate connected to a second node, where the pixel electric current flows from the first electrode to the second electrode, according to a voltage of the gate, a second transistor configured to selectively supply a data signal to a third node, a third transistor configured to selectively connect the second electrode of the first transistor with the gate of the first transistor, a fourth transistor configured to selectively supply a voltage of an initialization power supply to the second node, a fifth transistor configured to selectively supply a voltage of a first compensation power supply to the third node, a sixth transistor configured to selectively supply a voltage to a fourth node, a seventh transistor configured to selectively supply the pixel electric current to the organic light emitting diode, a first capacitor connected to the second node and the fourth node, and a second capacitor connected to the third node and the fourth node.

Another aspect is an organic light emitting display device, including a pixel unit including a plurality of pixels circuits, a data driving unit configured to supply a data signal to the pixel unit, a power supply unit configured to supply a first pixel power, a second pixel power, a first compensation power, and a second compensation power to the pixel unit, and a scanning driving unit configured to selectively supply the data signal, the first pixel power, the second pixel power, the first compensation power, and the second compensation power to the pixel unit such that pixel electric current corresponding to the data signal flows to the pixel, where each of the pixel circuits includes an organic light emitting diode configured to emit light according to a pixel electric current flowing from a first pixel power supply to a second pixel power supply, a first transistor including a first electrode connected to the first pixel power supply, a second electrode connected to a first node, and a gate connected to a second node, where the pixel electric current flows from the first electrode to the second electrode, according to a voltage of the gate, a second transistor configured to selectively supply a data signal to a third node, a third transistor configured to selectively connect the second electrode of the first transistor with the gate of the first transistor, a fourth transistor configured to selectively supply a voltage of an initialization power supply to the second node, a fifth transistor configured to selectively supply a voltage of a first compensation power supply to the third node, a sixth transistor configured to selectively supply a voltage to a fourth node, a seventh transistor configured to selectively supply the pixel electric current to the organic light emitting diode, a first capacitor connected to the second node and the fourth node, and a second capacitor connected to the third node and the fourth node.

BRIEF DESCRIPTION OF THE DRAWINGS

FIG. 4 is a timing diagram illustrating the operation of the pixel shown in

FIG. 3;

DETAILED DESCRIPTION OF CERTAIN INVENTIVE EMBODIMENTS

Figure 1:
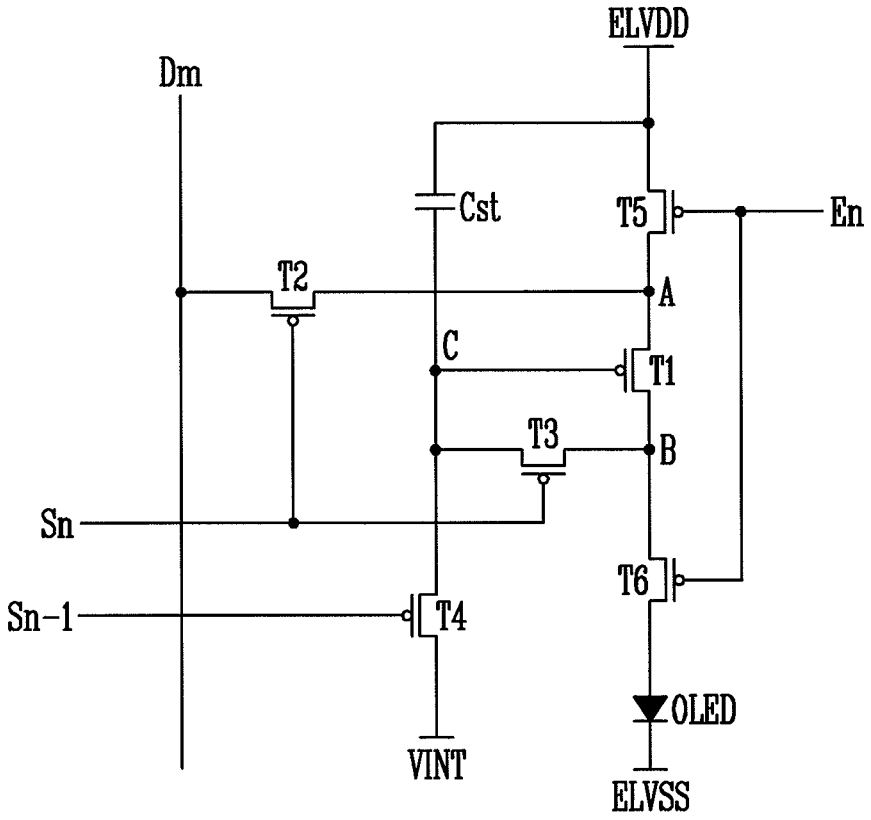
FIG. 1 is a circuit diagram illustrating a pixel employed in a common organic light emitting display device.

Hereinafter, certain exemplary embodiments will be described with reference to the accompanying drawings. Herein, when a first element is described as being coupled to a second element, the first element may not only be directly coupled to the second element but may be indirectly coupled to the second element via a third element. Further, some of the elements that are not essential to the complete understanding of the invention are omitted for clarity. Also, like reference numerals generally refer to like elements throughout.

Embodiments are generally described with reference to the accompanying drawings.

Figure 2:
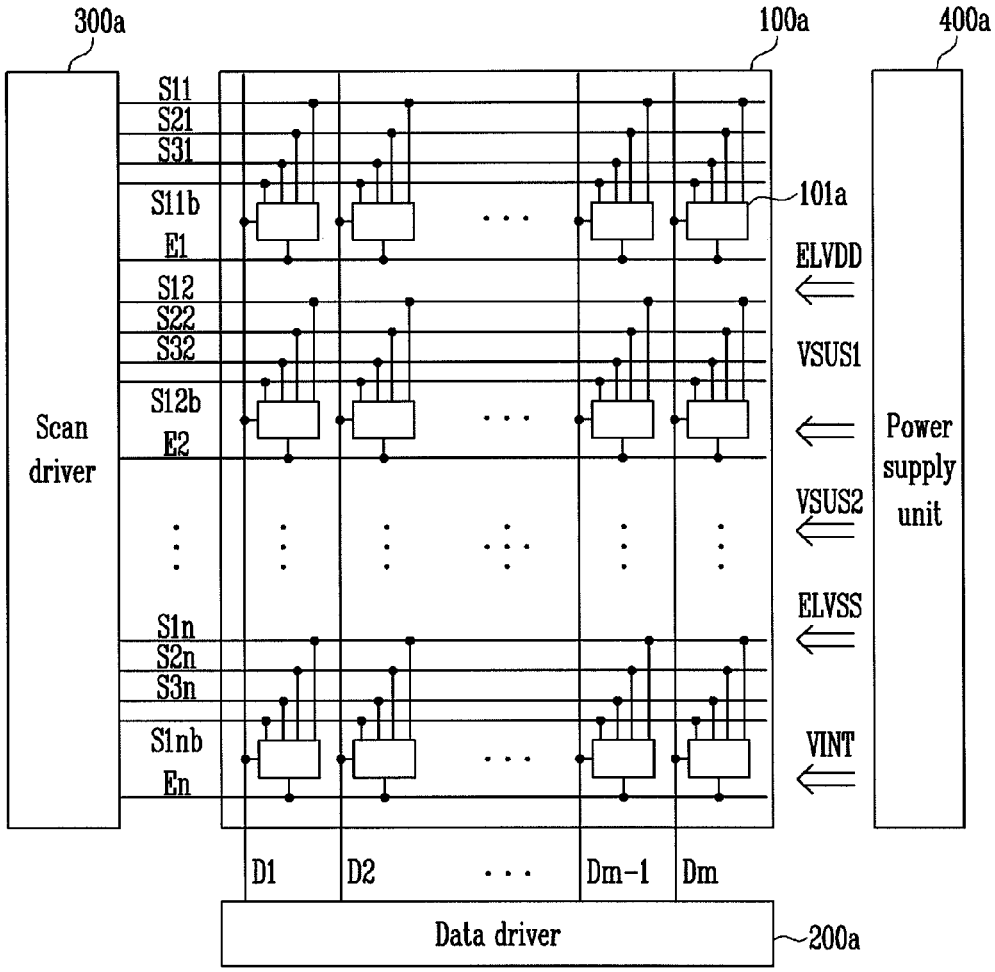
FIG. 2 is a diagram illustrating the structure of a first embodiment of an organic light emitting display device.

FIG. 2 is a diagram illustrating the structure of an organic light emitting display device. Referring to FIG. 2, an organic light emitting display device includes a pixel unit 100*a*, a data driving unit 200*a*, a scanning driving unit 300*a*, and a power supply unit 400*a*.

The pixel unit 100*a* includes m data lines D1, D2, . . . Dm−1, and Dm, n first scanning lines S11, S12, . . . S1*n*−1, and S1*n*, *n* first sub-scanning lines S11*b*, S12*b*, . . . S1*n*−1b, and S1*nb*, n second sub-scanning lines S21, S22, . . . S2*n*−1, and S2*n*, *n* third sub-scanning lines S31, S32, . . . S3*n*−1, and S3*n*, and *n* light emitting control lines E1, E2, . . . En−1, and En, and further includes a plurality of pixels 101*a* that are formed in the regions near intersections of the m data lines D1, D2, . . . Dm−1, and Dm, the n first scanning lines S11, S12, . . . S1*n*−1, and S1*n*, the n second sub-scanning lines S21, S22, . . . S2*n*−1, and S2*n*, the n third sub-scanning lines S31, S32, . . . S3*n*−1, and S3*n*, the first sub-scanning lines S11*b*, S12*b*, S1*n*−1b, and S1*nb*, and the n light emitting control lines E1, E2, . . . En−1, and En. The pixel 101*a* includes a pixel circuit with an organic light emitting element (not shown), generates pixel electric current that flows to the pixels according to data signals transmitted through the m data lines D1, D2, . . . Dm−1, and Dm, and scanning signal, sub-scanning signals, and light emitting control signals that are transmitted through the n first scanning lines S11, S12, . . . S1*n*−1, and S1*n*, the n first sub-scanning lines S11*b*, S12*b*, . . . S1*n*−1b, and S1*nb*, the n second sub-scanning lines S21, S22, . . . S2*n*−1, and S2*n*, and the n third sub-scanning lines S31, S32, . . . S3*n*−1, and S3*n* in the pixel circuit, and controls the flow of the pixel current to the organic light emitting elements. In this configuration, the second scanning signals that are transmitted to the pixels in the previous rows may be used instead of the third scanning signals transmitted through the third scanning lines S31, S32, . . . S3*n*−1, and S3*n*.

Further, electric current corresponding to the data signals is made flow to the pixel from a first pixel power supply ELVDD, to a second pixel power supply ELVSS, with use of a first compensation power supply VSUS1, a second compensation power supply VSUS2, and an initialization power supply VINT. In some embodiments, the voltage of the first compensation power supply VSUS1 is substantially equal to the voltage of the first pixel power supply ELVDD.

The data driving unit 200*a* is connected to the m data lines D1, D2, . . . Dm−1, and Dm, and generates data signals for one row and sequentially transmits them to the m data lines D1, D2, . . . Dm−1, and Dm.

The scanning driving unit 300*a* is connected with the n first scanning lines S11, S12, . . . S2*n*−1, and S1*n*, the n first sub-scanning lines S11, S12, . . . S1*n*−1, and S1*n*, the n second scanning lines S21, S22, . . . S2*n*−1, and S2*n*, and the n third scanning lines S31, S32, . . . S3*n*−1, and S3*n*, and generates and transmits first scanning signals, first sub-scanning signals, second scanning signals, and third scanning signals to the n first scanning lines S11, S12, . . . S1*n*−1, and S1*n*, the n first sub-scanning lines S11, S12, . . . S1*n*−1, and S1*n*, the n second scanning lines S21, S22, . . . S2*n*−1, and S2*n*, and the n third scanning lines S31, S32, . . . S3*n*−1, and S3*n*, respectively.

Further the scanning driving unit 300*a* is connected with the n light emitting control lines E1, E2, . . . En−1, and En, and generates and transmits light emitting control signals to the n light emitting control lines E1, E2, . . . En−1. Although, the light emitting control signals are shown to be generated by the scanning driving unit 300*a*, the light emitting control signals may be generated by another driving unit and transmitted to the n light emitting control lines E1, E2, . . . En−1.

The power supply unit 400*a* generates and transmits the first pixel power ELVDD, the second pixel power ELVSS, the first compensation power VSUS1, the second compensation power VSUS2, and the initialization power VINT to the pixel unit 100*a*.

Figure 3:
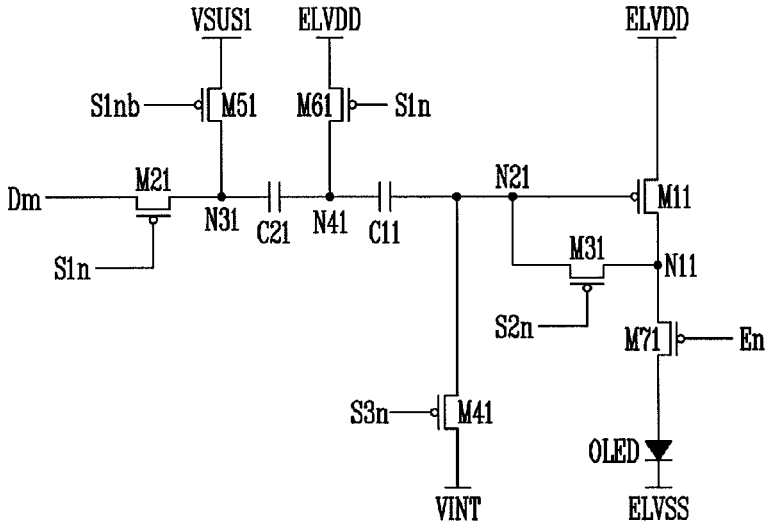
FIG. 3 is a circuit diagram illustrating an embodiment of a pixel employed in the organic light emitting display device shown in FIG. 2.

FIG. 3 is a circuit diagram illustrating an embodiment of a pixel employed in the organic light emitting display device shown in FIG. 2. Referring to FIG. 3, the pixel 101*a* includes a first to seventh transistors M11 to M71, first and second capacitors C11 and C21, and an organic light emitting diode OLED. Further, the first pixel power ELVDD and the second pixel power ELVSS having lower voltage than the first pixel power ELVDD are transmitted to the pixel 101*a*. In addition, the first compensation power VSUS1 and the initialization power VINT are transmitted to the pixel 101*a*.

The pixel 101*a* is connected to the data line Dm, the first scanning line S1*n*, the second scanning line S2*n*, the third scanning line S3*n*, the first sub-scanning line S1*nb*, and the light emitting control line En. Further, each of the transistors includes threes electrodes of source, drain, and gate, and assuming that the source is a first electrode, the drain may be a second electrode.

Regarding the first transistor M11, the source is connected to the first power supply ELVDD, the drain is connected to the first node N11, and the gate is connected to the second node 21.

Regarding the second transistor M21, the source is connected to the data line Dm, the drain is connected to the third node N31, and the gate is connected to the first scanning line S1*n*.

Regarding the third transistor M31, the source is connected to the first node N11, the drain is connected to the second node N21, and the gate is connected to the second scanning line S2*n*.

Regarding the fourth transistor M41, the source is connected to the initialization power supply VINT, the drain is connected to the second node N21, and the gate is connected to the third scanning line S3*n*.

Regarding the fifth transistor M51, the source is connected to the first compensation power supply VSUS1, the drain is connected to the third node N31, and the gate is connected to the first sub-scanning line S1*nb*.

Regarding the sixth transistor M61, the source is connected to the first pixel power supply ELVDD, the drain is connected to the fourth node N41, and the gate is connected to the first scanning line S1*n*.

Regarding the seventh transistor M71, the source is connected to the first node N11, the drain is connected to the organic light emitting diode OLED, and the gate is connected to the light emitting control line En.

Regarding the first capacitor C11, the first electrode is connected to the second node N21 and the second electrode is connected to the fourth node N41.

Regarding the second capacitor C21, the first electrode is connected to the fourth node N41 and the second electrode is connected to the third node N31.

Regarding the organic light emitting diode OLED, the anode is connected to the seventh transistor M71 and the cathode is connected to the second pixel power supply ELVSS.

Figure 4:
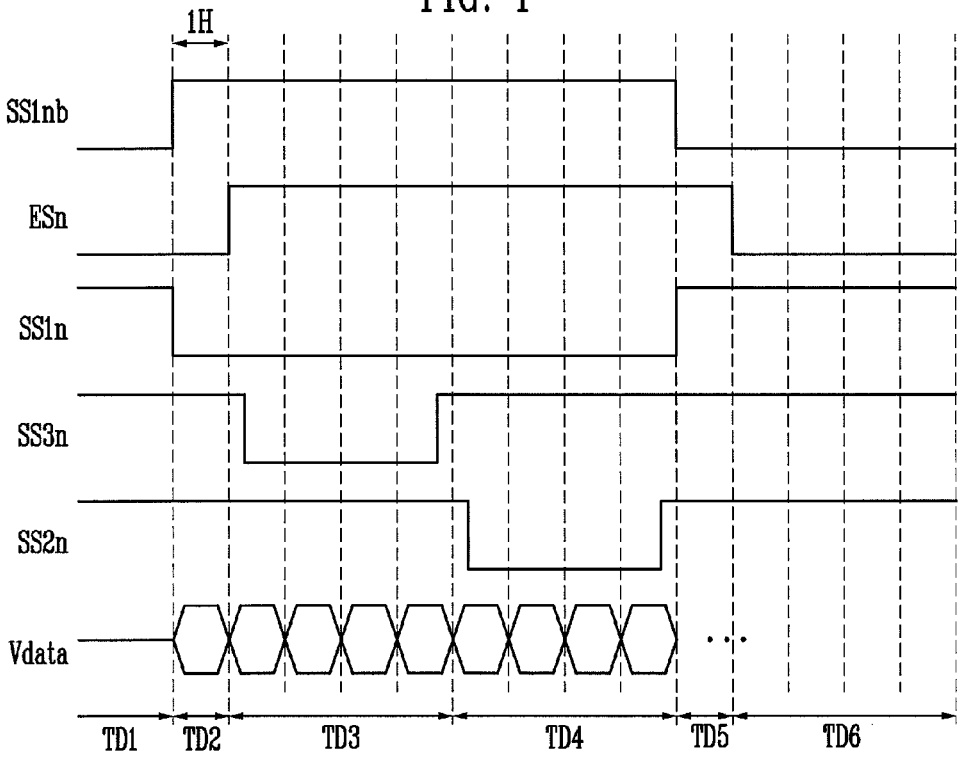

FIG. 4 is a timing diagram illustrating the operation of the pixel shown in FIG. 3. Referring to FIG. 4, signals that are inputted to the pixel 101*a* include a first scanning signal SS1*n*, a second scanning signal SS2*n*, a third scanning signal SS3*n*, a first sub-scanning signal SS1*nb*, and a light emitting control signal ESn.

First, in the first period TD1, the first scanning signal SS1*n*, the second scanning signal SS2*n*, and the third scanning signal SS3*n* are at the high state, and the first sub-scanning signal SS1*nb* and the light emitting control signal ESn are at the low state. Therefore, the second transistor M21, the third transistor M31, the fourth transistor M41, and the sixth transistor M61 are at the off-state, and the fifth transistor M51 and the seventh transistor M71 are at the on-state. Accordingly, the first compensation power VSUS1 is transmitted to the third node N31. The voltage of the first compensation power VSUS1 is set to correspond to the voltage of a data signal displaying black, such that electric current does not flow from the source to the drain of the first transistor M11, when the first compensation power VSUS1 is transmitted to the third node N31 and the second node N21 changes in voltage. Therefore, electric current does not flow to the organic light emitting diode OLED, even if the seventh transistor M71 is in the on-state.

In the second period TD2, the first scanning signal SS1*n* is maintained at the low state, the second scanning signal SS2*n* is maintained at the high state, the third scanning signal SS3*n* and the first sub-scanning signal SS1*nb* are maintained at the high state, and the light emitting control signal ESn is maintained at the low state. Therefore, the second transistor M21, the sixth transistor M61, and the seventh transistor M71 are at the on-state, and the third transistor M31, the fourth transistor M41, and the fifth transistor M51 are at the off-state. When the second transistor M21, the sixth transistor M61, and the seventh transistor M71 are at the on-state, a data signal Vdata is transmitted to the third node N31 and the first power ELVDD is transmitted to the fourth node N41 The voltage of the first power ELVDD is high, such that electric current does not flow to the organic light emitting diode OLED, even if the seventh transistor M71 are in the on-state.

In the third period TD3, the first scanning signal SS1*n* is maintained at the low state, and the first sub-scanning signal SS1*nb*, the second scanning signal SS2*n*, and the light emitting control signal ESn are maintained at the high state. Further, the third scanning signal SS3*n* changes from the high state to the low state. Therefore, the second transistor M21, the fourth transistor M41, and the sixth transistor M61 are in at the on-state, and the third transistor M31, the fifth transistor M51, and the seventh transistor M71 are in the off-state. Accordingly, the voltage of the data signal Vdata and the voltage of the first pixel power supply ELVDD are maintained. Further, the initialization power VINT is transmitted to the second node N21 by the fourth transistor M41.

In the fourth period TD4, the first scanning signal SS1*n* and the second scanning signal SS2*n* are maintained at the low state and the third scanning signal SS3*n* is maintained at the high state. Further, the first sub-scanning signal SS1*nb* and the light emitting control signal are maintained at the high state. Therefore, the second transistor M21, the third transistor M31, and the sixth transistor M61 are in the on-state, and the fourth transistor M41, the fifth transistor M51, and the seventh transistor M71 become off-state. Since the second transistor M21 and the sixth transistor M61 are at the on-state, the voltage of the data signal Vdata and the voltage of the first pixel power supply ELVDD are maintained at the third node N31 and the fourth node 41, respectively. Further, since the third transistor M31 is at the on-state, the first transistor M11 is diode connected, such that electric current flows from the source to the drain of the first transistor M11. In this process, since the seventh transistor M71 is at the off-state by the light emitting control signal, the flow of electric current to the organic light emitting diode OLED is blocked. Furthermore, as the first transistor M11 is diode connected, a voltage corresponding to the following Formula 2 is transmitted to the gate of the first transistor M11, $$Vg=ELVDD+Vth \quad \text{[Formula 2]}$$

where, Vg is gate voltage of the first transistor M11, ELVDD is voltage of the first pixel power supply ELVDD, and Vth is threshold voltage of the first transistor M11.

The length of the fourth period TD4 can change, and it is possible to ensure sufficient time that is taken to transmit the voltage corresponding to Formula 2 to the second node N21 by adjusting the length of the fourth period TD4.

In the fifth period TD5, the first scanning signal SS1*n*, the second scanning signal SS2*n*, the third scanning signal SS3*n*, and the light emitting control signal are maintained at the high state, and the first sub-scanning signal SS1*nb* is at the low state. The second transistor M21, the third transistor M31, the fourth transistor M41, the sixth transistor M61, and the seventh transistor M71 become off-state, and the fifth transistor M51 becomes the on-state. Therefore, the voltage of the third node N31 is changed from the voltage of the data signal Vdata to the voltage of the first compensation power supply VSUS1. Further, since the fourth transistor M41 and the sixth transistor M61 are in the off-state, the voltage of the fourth node N41 and the second node N21 changes by the difference between the voltage of the data signal and the voltage of the first compensation power supply VSUS1.

Therefore, the voltage of the second node N21 changes to the voltage corresponding to the following Formula 3, in which the voltage of the second node N21 is the voltage of the gate of the first transistor M11, $$Vg=ELVDD+Vth-(V\text{data}-\text{VSUS1}) \quad \text{[Formula 3]}$$

where, Vg is the gate voltage of the first transistor M11, ELVDD is the voltage of the first pixel power supply ELVDD, Vth is the threshold voltage of the first transistor M11, Vdata is the voltage of the data signal Vdata, and VSUS1 is the voltage of the first compensation power supply VSUS1.

In the sixth period TD6, the first scanning signal SS1*n*, the second scanning signal SS2*n*, and the third scanning signal SS3*n* are maintained at the high state, and the first sub-scanning signal SS1*nb* and the light emitting control signal ESn are maintained at the low state. Therefore, the second transistor M21, the third transistor M31, the fourth transistor M41, and the sixth transistor M61 are in the off-state, and the fifth transistor M51 and the seventh transistor M71 are in the on-state. Since the seventh transistor M71 is in the on-state, electric current corresponding to the voltage transmitted to the gate of the first transistor M11 flows to the organic light emitting diode OLED. Further, since the first compensation power VSUS1 is still transmitted to the third node N31, there is no change in voltage of the gate of the first transistor M11 during the fifth period TD5.

Therefore, the current flowing to the organic light emitting diode OLED is represented by the following Formula 4, $$\begin{aligned} Ids = \beta(Vgs - Vth)^2 &= \beta(ELVDD - (ELVDD + Vth + VSUS1 - Vdata) + Vth)^2 \\ &= \beta(Vdata - Vsus1)^2 \end{aligned} \quad \text{[Formula 4]}$$

where, Ids is electric current flowing to the organic light emitting diode OLED, 13 is a constant, and Vgs is voltage between the source and the gate of the first transistor M11.

Therefore, the electric current flowing to the organic light emitting diode OLED corresponds to the voltage of the first compensation power supply VSUS1 and the data signal Vdata. That is, the current is independent of variation of the threshold voltage of the first transistor M11 and the voltage of the first pixel power supply ELVDD. Accordingly, the circuit of FIG. 3 compensates for variation of the threshold voltage of the first transistor M11 and the voltage of the first pixel power supply ELVDD.

Further, the gate voltage of the first transistor M11 is not changed even if the voltage of the data signal Vdata flowing to the data line Dm changes. A change in the voltage of the data signal Vdata does not affect the gate voltage of the first transistor M11 because the voltage of the first compensation power supply VSUS1 is applied to node N31 while the organic light emitting diode OLED emits light. Therefore, it is possible to prevent cross-talk that would otherwise be generated by a change in voltage of the data signal Vdata.

Figure 5:
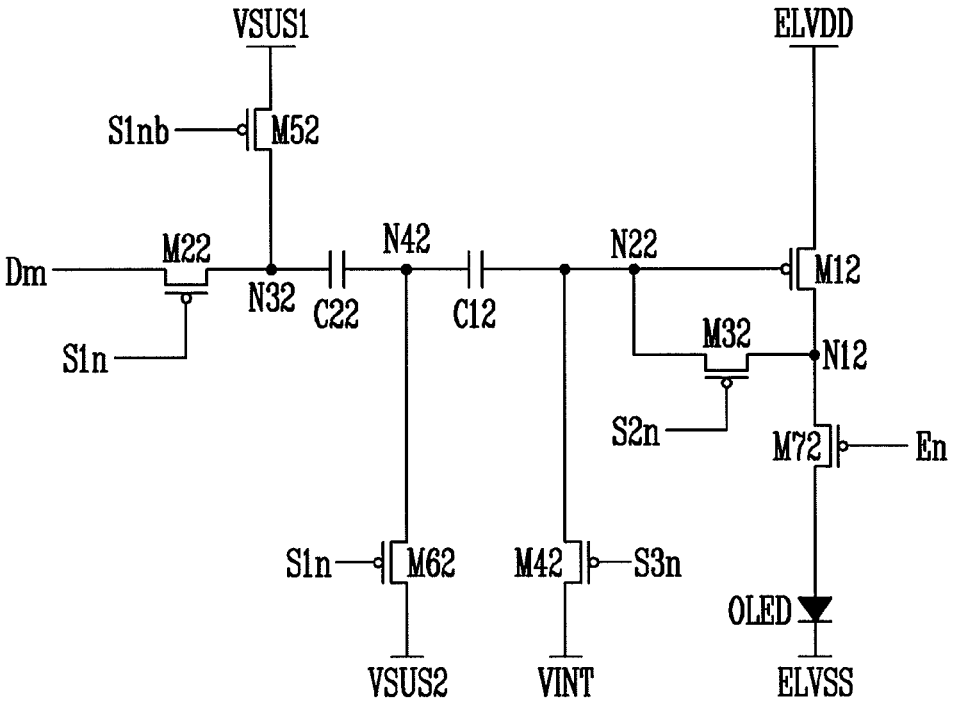
FIG. 5 is a circuit diagram illustrating an embodiment of a pixel employed in the organic light emitting display device shown in FIG. 2.

FIG. 5 is a circuit diagram illustrating an embodiment of a pixel circuit employed in the organic light emitting display device shown in FIG. 2. Referring to FIG. 5, the pixel circuit includes first to seventh transistors M12 to M72, first and second capacitors C12 and C22, and an organic light emitting diode OLED. Further, the first pixel power ELVDD and the second pixel power ELVSS having lower voltage than the first pixel power ELVDD are transmitted to the pixel circuit. Furthermore, the first compensation power VSUS1, the second compensation power VSUS2, and the initialization power VINT are transmitted to the pixel circuit. In addition, the pixel circuit is connected to the first scanning line S1*n*, the second scanning line S2*n*, the third scanning line S3*n*, the first sub-scanning line S1*nb*, and the light emitting control line En.

Regarding the first transistor M12, the source is connected to the first pixel power supply ELVDD and the drain is connected to the first node N12. Further, the gate is connected to the second node N22.

Regarding the second transistor M22, the source is connected to the data line Em, the drain is connected to the third node N32, and the gate is connected to the first scanning line S1*n*.

Regarding the third transistor M32, the source is connected to the first node N12, the drain is connected to the second node N22, and the gate is connected to the second scanning line S2*n*.

Regarding the fourth transistor M42, the source is connected to the initialization power supply VINT, the drain is connected to the second node N22, and the gate is connected to the third scanning line S3*n*.

Regarding the fifth transistor M52, the source is connected to the first compensation power supply VSUS1, the drain is connected to the third node N32, and the gate is connected to the first sub-scanning line S1*nb*.

Regarding the sixth transistor M62, the source is connected to the second compensation power supply VSUS2, the drain is connected to the fourth node N42, and the gate is connected to the first scanning line S1*n*.

Regarding the seventh transistor M72, the source is connected to the first node N12, the drain is connected to the organic light emitting diode OLED, and the gate is connected to the light emitting control signal En.

Regarding the first capacitor C12, the first electrode is connected to the second node N22 and the second node is connected to the fourth node N42.

Regarding the second capacitor C22, the first electrode is connected to the fourth node N42 and the second electrode is connected to the third node N32.

Regarding the organic light emitting diode OLED, the anode is connected to the seventh transistor M72 and the cathode is connected to the second pixel power supply ELVSS.

The pixel circuit of FIG. 5 has a difference from the pixel shown in FIG. 3, in that not the pixel power ELVDD, but the second compensation power VSUS2 is transmitted to the source of the sixth transistor M62. However, the circuit of FIG. 5 generally operates the same as the pixel circuit shown in FIG. 3, and has similar beneficial aspects.

Figure 6:
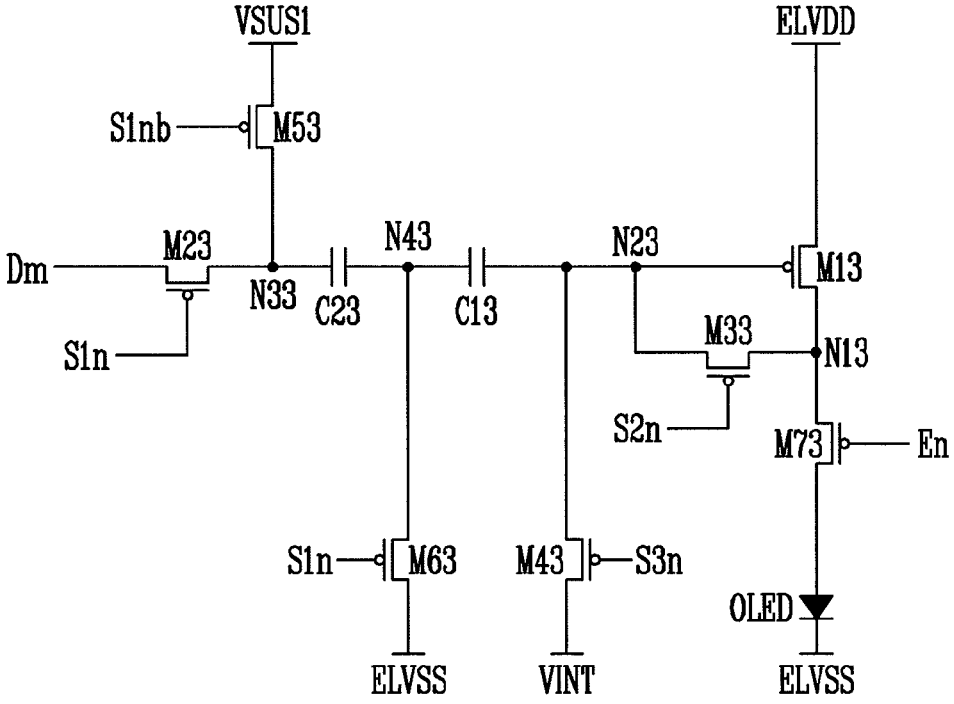
FIG. 6 is a circuit diagram illustrating an embodiment of a pixel employed in the organic light emitting display device shown in FIG. 2.

Referring FIG. 6, the pixel circuit includes first to seventh transistors M13 to M73, first and second capacitor C13 and C23, and an organic light emitting diode OLED. Further, the first pixel power ELVDD and the second pixel power ELVSS having voltage less than the first pixel power ELVDD are transmitted to the pixel circuit. Furthermore, the first compensation power VSUS1 and the initialization power VINT are transmitted to the pixel circuit. In addition, the pixel circuit is connected with the data line Dm, the first scanning line S1*n*, the second scanning line S2*n*, the third scanning line S3*n*, the first sub-scanning line S1*nb*, and the light emitting control line En.

Regarding the first transistor M13, the source is connected to the first pixel power supply ELVDD and the drain is connected to the first node N13. Further, the gate is connected to the second node N23.

Regarding the second transistor M23, the source is connected to the data line Dm, the drain is connected to the third node N33, and the gate is connected to the first scanning line S1*n*.

Regarding the third transistor M33, the source is connected to the first node N13, the drain is connected to the second node N23, and the gate is connected to the second scanning line S2*n*.

Regarding the fourth transistor M43, the source is connected to the initialization power supply VINT, the drain is connected to the second node N23, and the gate is connected to the third scanning line S3*n*.

Regarding the fifth transistor M53, the source is connected to the first compensation power supply VSUS1, the drain is connected to the third node N33, and the gate is connected to the first sub-scanning line S1*nb*.

Regarding the sixth transistor M63, the source is connected to the second pixel power supply ELVSS, the drain is connected to the fourth node N43, and the gate is connected to the first scanning line S1*n*.

Regarding the seventh transistor M73, the source is connected to the first node N13, the drain is connected to the organic light emitting diode OLED, and the gate is connected to the light emitting control line En.

Regarding the first capacitor C13, the first electrode is connected to the second node N23 and the second node is connected to the fourth node N43.

Regarding the second capacitor C23, the first electrode is connected to the fourth node N43 and the second electrode is connected to the third node N33.

Regarding the organic light emitting diode OLED, the anode is connected to the seventh transistor M73 and the cathode is connected to the second pixel power supply ELVSS.

The pixel circuit connected as described above has a difference from the pixel shown in FIG. 3 in that not the pixel power supply ELVDD, but the second pixel power supply ELVSS is connected to the source of the sixth transistor M63. However, the circuit of FIG. 6 generally operates the same as the pixel circuit shown in FIG. 3, and has similar beneficial aspects.

Figure 7:
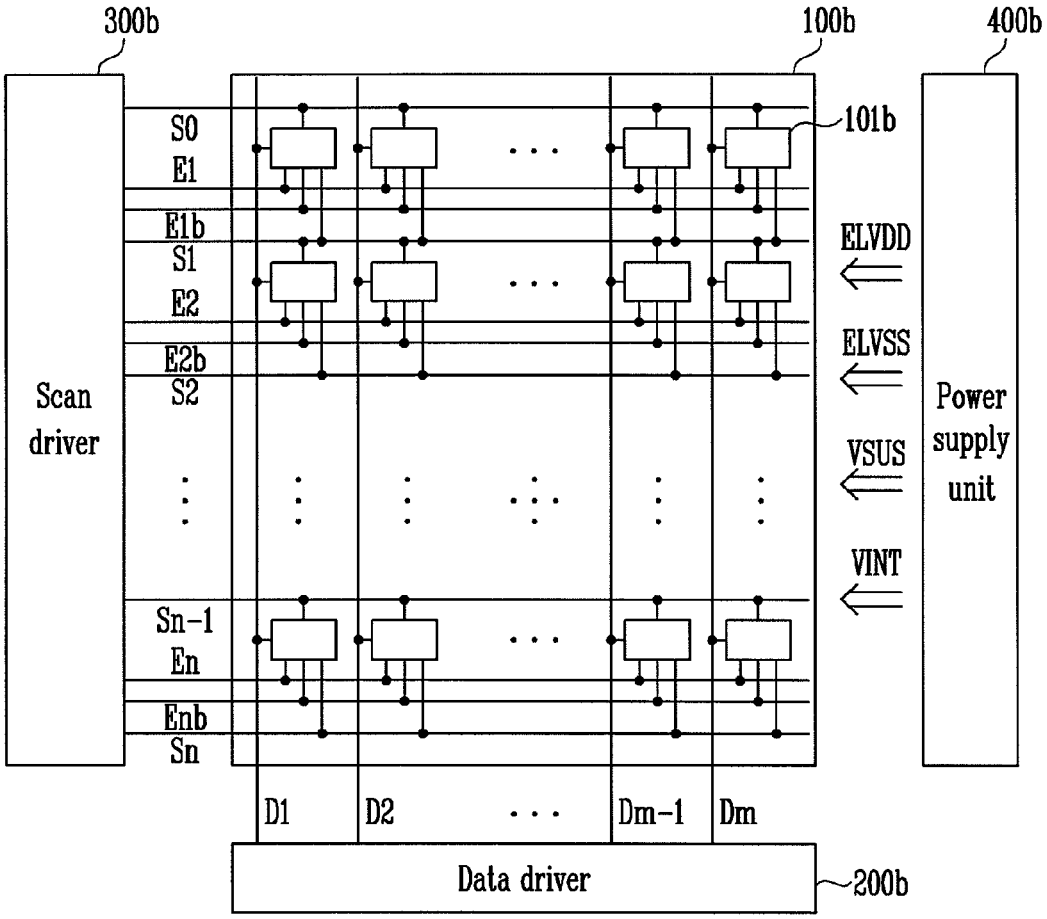
FIG. 7 is a diagram illustrating the structure of an embodiment of an organic light emitting display device.

FIG. 7 is a diagram illustrating the structure of a second embodiment of an organic light emitting display device. Referring to FIG. 7, the organic light emitting display device includes a pixel unit 100*b*, a data driving unit 200*b*, a scanning driving unit 300*b*, and a power supply unit 400*b*.

The pixel unit 100*b* includes m data lines D1, D2, . . . Dm−1, and Dm, n+1 scanning lines S0, S1, . . . Sn−1, and Sn, n light emitting control lines E1, E2, . . . En−1, and En, and n sub-light emitting control lines E1*b*, E2*b*, . . . En−1b, and Enb. Further, it includes a plurality of pixels 101*b* that are formed in regions near intersections of the m data lines D1, D2, . . . Dm−1, and Dm, the n+1 scanning lines S0, S1, Sn−1, and Sn, the n light emitting control lines E1, E2, . . . En−1, and En, and the n sub-light emitting control lines E1*b*, E2*b*, . . . En−1b, and Enb. A pixel 101*b* includes a pixel circuit with an organic light emitting diode, generates in the pixel electric current corresponding to data signals, using data signals transmitted through the m data lines D1, D2, . . . Dm−1, and Dm, scanning signals, light emitting control signals, and sub-light emitting control signals that are transmitted through the n+1 scanning lines S0, S1, . . . Sn−1, and Sn, the n light emitting control lines E1, E2, . . . En−1, and En, and the n sub-light emitting control lines E1*b*, E2*b*, . . . En−1b, and Enb, respectively, and controls flow of the electric current to the organic light emitting diode. Further, it allows electric current corresponding to the data signals to flow to the pixel by receiving the first pixel power ELVDD, the second pixel power ELVSS, the compensation power VSUS, and the initialization power VINT.

The data driving unit 200*b* is connected with the m data lines D1, D2, . . . Dm−1, and Dm, generates data signals for each row, and sequentially transmits them to the m data lines D1, D2, . . . Dm−1, and Dm.

The scanning driving unit 300*b* is connected to the n+1 scanning lines. S0, S1, . . . Sn−1, and Sn, the n light emitting control lines E1, E2, . . . En−1, and En, and the n sub-light emitting control lines E1*b*, E2*b*, . . . En−1b, and Enb, and generates and transmits scanning signals, light emitting control signals, and sub-light emitting control signals to the n scanning lines S0, S1, . . . Sn−1, and Sn, the n light emitting control lines E1, E2, . . . En−1, and En, and the n sub-light emitting control lines E1*b*, E2*b*, . . . En−1b, and Enb.

Although the light emitting control signals and the sub-light emitting control signals are shown to be generated by the scanning driving unit 300*b*, it is possible to generate the light emitting control signals and the sub-light emitting control signals at another driving unit and to transmit them to the n light emitting control lines E1, E2, . . . En−1, and En and n sub-light emitting control lines E1*b*, E2*b*, . . . En−1b, and Enb.

The power supply unit 400*b* generates and transmits the first pixel power ELVDD, the second pixel power ELVSS, the compensation power VSUS, and the initialization power VINT to the pixel unit 100*b*.

Figure 8:
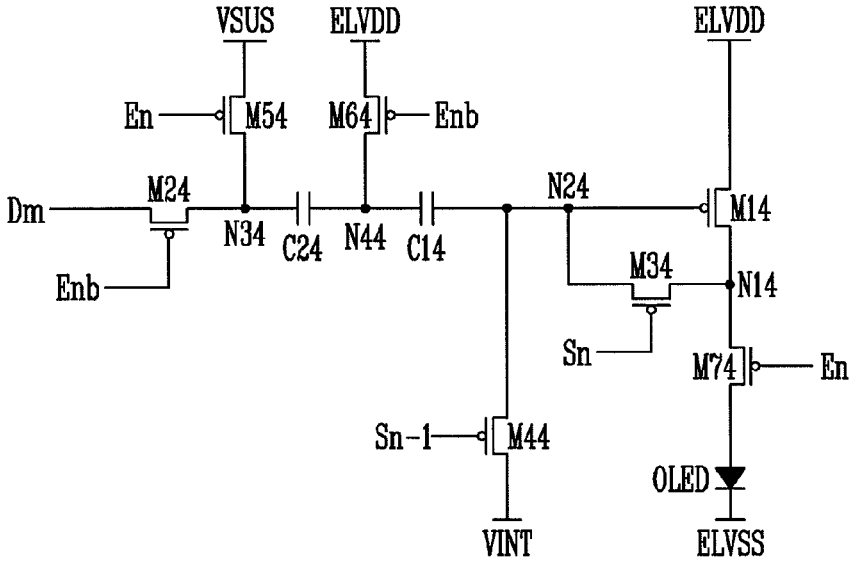
FIG. 8 is a circuit diagram illustrating an embodiment of a pixel employed in the organic light emitting display device shown in FIG. 6.

FIG. 8 is a circuit diagram illustrating an embodiment of a pixel circuit employed in the organic light emitting display device shown in FIG. 7. Referring to FIG. 8, the pixel circuit includes first to seventh transistors M14 to M74, first and second capacitors C14 and C24, and an organic light emitting diode OLED. Further, the first pixel power ELVDD and the second pixel power ELVSS having lower voltage than the first pixel power ELVDD are transmitted to the pixel circuit. Further, the compensation power VSUS and the initialization power VINT are transmitted to the pixel circuit. Furthermore, the pixel circuit is connected with the data line Dm, the first scanning line Sn, the second scanning line Sn−1, the light emitting control line En, and the sub-light emitting control line Enb. In addition, each of the transistors include three electrodes of a source, a drain, and a gate, and when the source is a first electrode, the drain may be a second electrode.

Regarding the first transistor M14, the source is connected to the first pixel power supply ELVDD and the drain is connected to the first node N14. Further, the gate is connected to the second node N24.

Regarding the second transistor M24, the source is connected to the data line Dm, the drain is connected to the third node N34, and the gate is connected to the sub-light emitting control line Enb.

Regarding the third transistor M34, the source is connected to the first node N14, the drain is connected to the second node N24, and the gate is connected to the first scanning line Sn.

Regarding the fourth transistor M44, the source is connected to the initialization power supply VINT, the drain is connected to the second node N24, and the gate is connected to the second scanning line Sn−1.

Regarding the fifth transistor M54, the source is connected to the compensation power supply VSUS, the drain is connected to the third node N34, and the gate is connected to the light emitting control lines En.

Regarding the sixth transistor M64, the source is connected to the firs pixel power supply ELVDD, the drain is connected to the fourth node N44, and the gate is connected to the sub-light emitting control line Enb.

Regarding the seventh transistor M74, the source is connected to the first node N14, the drain is connected to the organic light emitting diode OLED, and the gate is connected to the first light emitting control line En.

Regarding the first capacitor C14, the first electrode is connected to the second node N24 and the second electrode is connected to the fourth node N44.

Regarding the second capacitor C24, the first electrode is connected to the fourth node N44 and the second electrode is connected to the third node N34.

Regarding the organic light emitting diode OLED, the anode is connected to the seventh transistor M74 and the cathode is connected to the second pixel power supply ELVSS.

Figure 9:
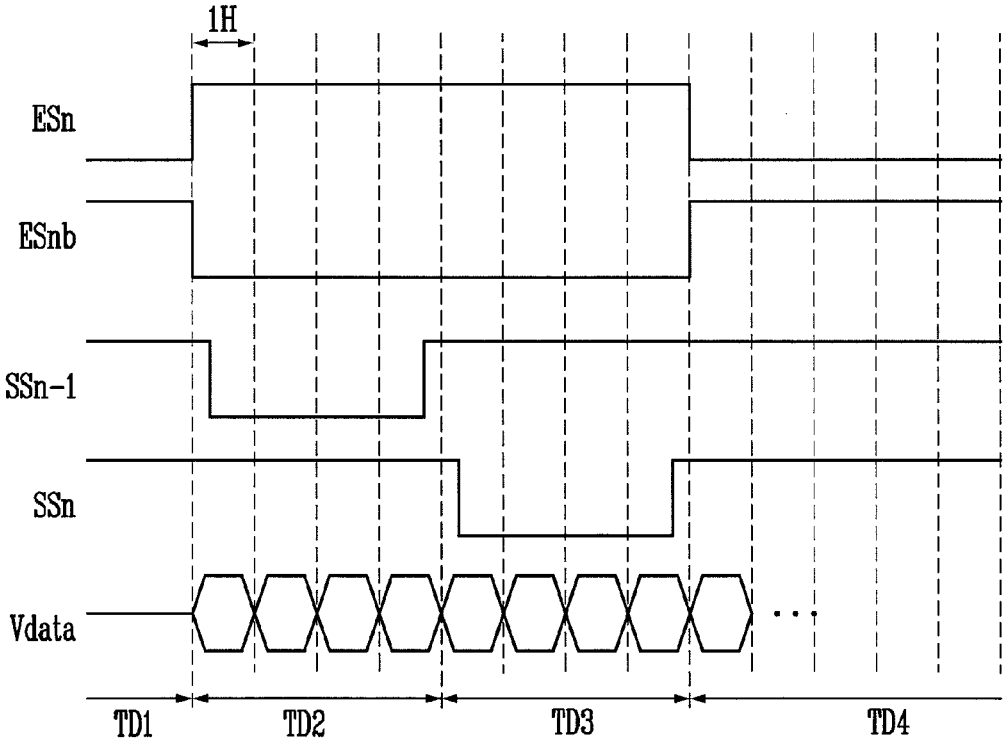
FIG. 9 is a timing diagram illustrating the operation of the pixel show in FIG. 8.

FIG. 9 is a timing diagram illustrating the operation of the pixel show in FIG. 8. Referring to FIG. 9, signals that are inputted to the pixel circuit include a first scanning signal SSn, a second scanning signal SSn−1, a light emitting control signal ESn, and a sub-light emitting control signal ESnb.

During the first period TD1, the first scanning signal SSn, the second scanning signal SSn−1, and the sub-light emitting control signal ESnb are at the high state and the light emitting control signal ESn is at the low state. Therefore, the fifth transistor M54 and the seventh transistor M74 are in the on-state, and the second transistor M24, the third transistor M34, the fourth transistor M44, and the sixth transistor M64 are in the off-state. Accordingly, the compensation power VSUS is transmitted to the third node N34. The voltage of the compensation power VSUS is set to correspond to the voltage of a data signal displaying black, such that electric current does not flow from the source to the drain of the first transistor M14, when the compensation power VSUS is transmitted to the third node N34 and the second node N24 changes in voltage. Therefore, electric current does not flow to the organic light emitting diode OLED, even if the seventh transistor M73 is in the on-state.

In the second period TD2, the first scanning signal SSn and the light emitting control signal ESn are in the high state, and the second scanning signal SSn−1 and the sub-light emitting control signal ESnb are in the low state. Therefore, the second transistor M24, the fourth transistor M44, and the sixth transistor M64 are in the on-state, and the third transistor M34, the fifth transistor M54, and the seventh transistor M74 are in the off-state. As a result, a data signal is transmitted to the third node N34 through the second transistor M24 and the voltage of the initialization power supply VINT is transmitted to the second node N24 by the fourth transistor M44. Further, the voltage of the first pixel power supply ELVDD is transmitted to the fourth node N44 by the sixth transistor M64.

In the third period TD3, the first scanning signal SSn and the sub-light emitting control signal ESnb are in the low state, and the second scanning signal SSn and the light emitting control signal ESn are in the high state. In this configuration, the second transistor M24, the third transistor M34, and the sixth transistor M64 are in the on-state, and the fourth transistor M44 and the fifth transistor M54 are in the off-state. Therefore, the data signal is still transmitted to the third node 34 by the second transistor M24 and the first node N14 and the second node N24 are connected by the third transistor M34, such that the first transistor M14 is diode connected. In this configuration, flow of electric current to the organic light emitting diode OLED is blocked by the seventh transistor M74. Because the first transistor M14 is diode connected, a voltage corresponding to Formula 2 is maintained at the gate of the first transistor M14.

In the fourth period TD4, the light emitting control signal ESn is in the low state and the first scanning signal SS1*n*, the second scanning signal SSn−1, and the sub-light emitting control signal ESnb are in the high state. Therefore, the second transistor M24, the third transistor M34, and the sixth transistor are in the off-state, and the fifth transistor M54 and the seventh transistor M73 are in the on-state. Accordingly, the voltage of the third node N34 is changed from the voltage of the data signal to the voltage of the compensation power supply VSUS, and the voltage of the second node N24 is changed from the voltage of the initialization power supply VINT by the first capacitor C14 and the second capacitor C24, such that the voltage of the second node N24 changes to a voltage represented by the following Formula 5, $$Vg=ELVDD+Vth-(Vdata-VSUS) \quad \text{[Formula 5]}$$

where, Vg is gate voltage of the first transistor M14, ELVDD is voltage of the first pixel power supply ELVDD, Vth is threshold voltage of the first transistor M14, Vdata is voltage of the data signal Vdata, and VSUS is voltage of the compensation power supply VSUS.

Further, since the seventh transistor M74 is in the on-state, electric current flows from the first power supply to the second power supply, such that electric current represented by the following Formula 6 flows to the organic light emitting diode OLED, $$\begin{aligned} Ids = \beta(Vgs - Vth)^2 &= \beta(ELVDD - (ELVDD + Vth + VSUS - Vdata) + Vth)^2 \\ &= \beta(Vdata - Vsus)^2 \end{aligned} \quad \text{[Formula 6]}$$

where, Ids is electric current flowing to the organic light emitting diode OLED, β is a constant, and Vgs is voltage between the source and the gate of the first transistor M14.

Therefore, the electric current flowing to the organic light emitting diode OLED flows according to the voltage of the voltage of the compensation power supply VSUS and the data signal Vdata. That is, variation in the threshold voltage of the first transistor M14 and an IR-drop in the voltage of the first pixel power supply ELVDD do not affect the current.

Further, the gate voltage of the first transistor M14 is not changed even if the voltage of the data signal Vdata flowing to the data line Dm changes. A change in the voltage of the data signal Vdata does not affect the gate voltage of the first transistor M14 because the voltage of the compensation power supply VSUS is applied to node N34 while the organic light emitting diode OLED emits light. Therefore, it is possible to prevent cross-talk which would otherwise be generated by changes in the data signal Vdata flowing to the data line Dm.

Figure 10:
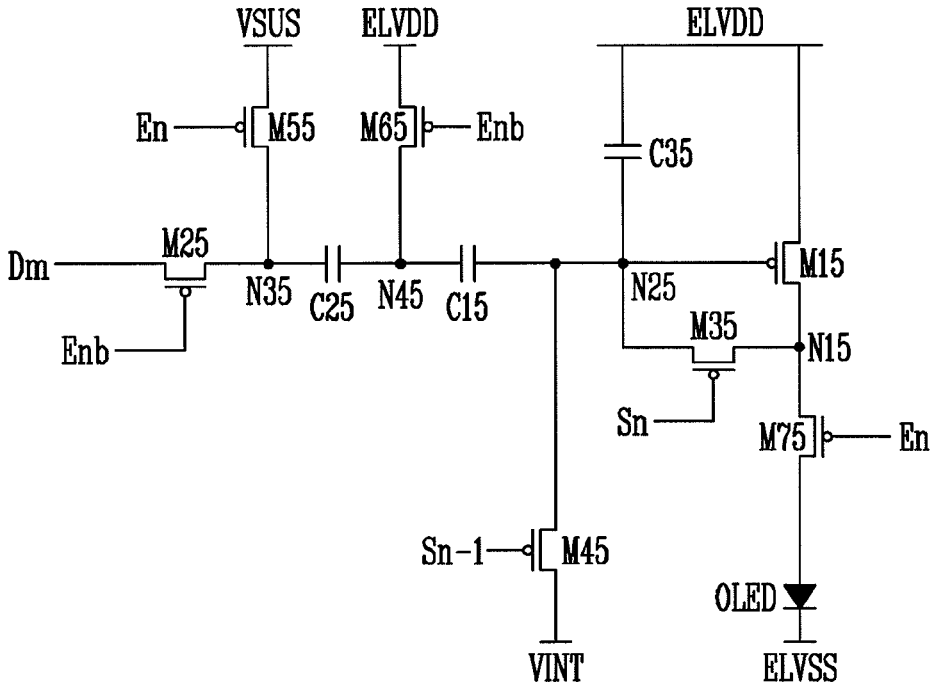
FIG. 10 is a circuit diagram illustrating an embodiment of a pixel employed in the organic light emitting display device shown in FIG. 6.

FIG. 10 is a circuit diagram illustrating an embodiment of a pixel circuit employed in the organic light emitting display device shown in FIG. 7. Referring to FIG. 10, the pixel circuit includes first to seventh transistors M15 to M17, first to third capacitors C15 to C35, and on organic light emitting diode OLED. Further, the first pixel power ELVDD and the second pixel power ELVSS having a lower voltage to the first pixel power ELVDD are transmitted to the pixel circuit. In addition, the compensation power VSUS is transmitted to the pixel circuit. Furthermore, the pixel circuit is connected with the data line Dm, the first scanning line S1*n*, the second scanning line S2*n*, the light emitting control line En, and the sub-light emitting control line Enb. In addition, each of the transistors includes three electrodes of a source, a drain, and a gate, and when that the source is a first electrode, the drain may be a second electrode.

Regarding the first transistor M15, the source is connected to the first pixel power supply ELVDD and the drain is connected to the first node N15. Further, the gate is connected to the second node N25.

Regarding the second transistor M25, the source is connected to the data line Dm, the drain is connected to the third node N35, and the gate is connected to the sub-light emitting control line Enb.

Regarding the third transistor M35, the source is connected to the first node N15, the drain is connected to the second node N25, and the gate is connected to the first scanning line Sn.

Regarding the fourth transistor M45, the source is connected to the initialization power supply VINT, the drain is connected to the second node N25, and the gate is connected to the second scanning line Sn−1.

Regarding the fifth transistor M55, the source is connected to the compensation power supply VSUS, the drain is connected to the third node N35, and the gate is connected to the light emitting control line En.

Regarding the sixth transistor M65, the source is connected to the first pixel power supply ELVDD, the drain is connected to the fourth node N45, and the gate is connected to the sub-light emitting control line Enb.

Regarding the seventh transistor M75, the source is connected to the first node N15, the drain is connected to the organic light emitting diode OLED, and the gate is connected to the light emitting control line En.

Regarding the first capacitor C15, the first electrode is connected to the second node N25 and the second electrode is connected to the fourth node N45.

Regarding the second capacitor C25, the first electrode is connected to the fourth node N45 and the second electrode is connected to the third node N35.

Regarding the third capacitor C35, the first electrode is connected to the first pixel power supply ELVDD and the second electrode is connected to the second node N25.

Regarding the organic light emitting diode OLED, the anode is connected to the seventh transistor M75 and the cathode is connected to the second pixel power supply ELVSS.

Figure 11:
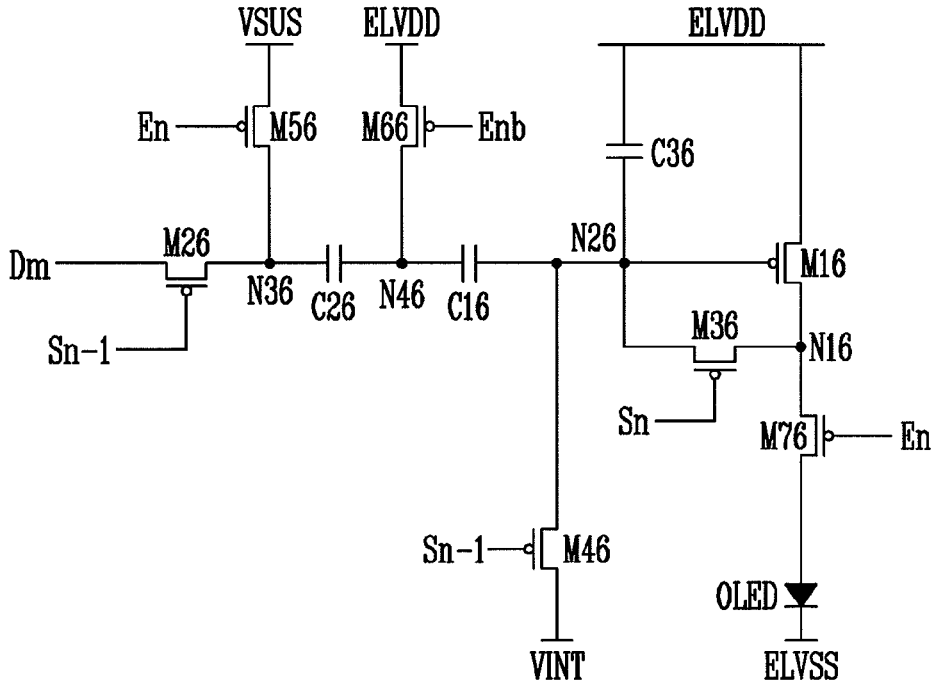
FIG. 11 is a circuit diagram illustrating an embodiment of pixel employed in the organic light emitting display device shown in FIG. 7.

FIG. 11 is a circuit diagram illustrating another embodiment of a pixel circuit employed in the organic light emitting display device shown in FIG. 7. Referring to FIG. 11, the pixel circuit includes a first to seventh transistors M16 to M76, first to third capacitors C16 to C36, and an organic light emitting diode OLED. Further, the first pixel power ELVDD and the second pixel power ELVSS having a lower voltage than the first pixel power ELVDD are transmitted to the pixel 101*b*. Further, the compensation power VSUS is transmitted to the pixel circuit. Furthermore, the pixel circuit is connected with the data line Dm, the first scanning line S1*n*, the second scanning line S2*n*, the light emitting control line En, and the sub-light emitting control line Enb Regarding the first transistor, the source is connected to the first pixel power supply ELVDD and the drain is connected to the first node N16. Further, the gate is connected to the second node N26.

Regarding the second transistor M26, the source is connected to the data line Dm, the drain is connected to the third node N36, and the gate is connected to the second scanning line Sn−1.

Regarding the third transistor M36, the source is connected to the first node N15, the drain is connected to the second node N26, and the gate is connected to the first scanning line Sn.

Regarding the fourth transistor M46, the source is connected to the initialization power supply VINT, the drain is connected to the second node N26, and the gate is connected to the second scanning line Sn−1.

Regarding the fifth transistor M56, the source is connected to the compensation power supply VSUS, the drain is connected to the third node N36, and the gate is connected to the light emitting control line En.

Regarding the sixth transistor M66, the source is connected to the first pixel power supply ELVDD, the drain is connected to the fourth node N46, and the gate is connected to the sub-light emitting control line Enb.

Regarding the seventh transistor M76, the source is connected to the first node N16, the drain is connected to the organic light emitting diode OLED, and the gate is connected to the light emitting control line En.

Regarding the first capacitor C16, the first electrode is connected to the second node N26 and the second electrode is connected to the fourth node N46.

Regarding the second capacitor C26, the first electrode is connected to the fourth node N46 and the second electrode is connected to the third node N36.

Regarding the third capacitor C36, the first electrode is connected to the first pixel power supply ELVDD and the second electrode is connected to the second node N26.

Regarding the organic light emitting diode OLED, the anode is connected to the seventh transistor M76 and the cathode is connected to the second pixel power supply ELVSS.

The pixel circuits of FIGS. 10 and 11 have operation and advantages which are similar to those of pixel circuits described above.

While certain exemplary embodiments have been described, it is to be understood that the invention is not limited to the disclosed embodiments, but, on the contrary, is intended to cover various modifications and equivalent arrangements.

What is claimed is:

1. An organic light emitting display device, comprising:

a pixel unit comprising a plurality of pixels circuits;

a data driving unit configured to supply a data signal to the pixel unit;

a power supply unit configured to supply a first pixel power, a second pixel power, a first compensation power, and a second compensation power to the pixel unit; and a scanning driving unit configured to selectively supply the data signal, the first pixel power, the second pixel power, the first compensation power, and the second compensation power to the pixel unit such that pixel electric current corresponding to the data signal flows to the pixel, wherein each of the pixel circuits includes:

an organic light emitting diode configured to emit light according to a pixel electric current flowing from a first pixel power supply to a second pixel power supply;

a first transistor comprising a first electrode connected to the first pixel power supply, a second electrode connected to a first node, and a gate connected to a second node, wherein the pixel electric current flows from the first electrode to the second electrode, according to a voltage of the gate;

a second transistor configured to selectively supply a data signal to a third node;

a third transistor configured to selectively connect the second electrode of the first transistor with the gate of the first transistor;

a fourth transistor configured to selectively supply a voltage of an initialization power supply directly to the second node;

a fifth transistor configured to selectively supply a voltage of a first compensation power supply directly to the third node, wherein the first compensation power supply is different from each of the first pixel power supply, the second pixel power supply and the initialization power supply;

a sixth transistor configured to selectively supply a voltage directly to a fourth node;

a seventh transistor configured to selectively supply the pixel electric current to the organic light emitting diode;

a first capacitor directly connected to the second node and the fourth node; and a second capacitor directly connected to the third node and the fourth node.

2. The organic light emitting display device of claim 1, wherein the voltage of the first compensation power supply is substantially the same as a voltage of a data signal for displaying black.

3. The organic light emitting display device of claim 1, wherein the voltage of the first compensation power supply is substantially equal to the voltage of the first pixel power supply.

4. The organic light emitting display device of claim 1, wherein the voltage supplied by the sixth transistor to the fourth node is any one of the voltage of the first pixel power supply and the voltage of the second pixel power supply.

5. The organic light emitting display device of claim 1, wherein the second transistor and the sixth transistor are determined to be turned on and off by a first scanning signal, the third transistor is determined to be turned on and off by a second scanning signal, the fourth transistor is determined to be turned on and off by a third scanning signal, the fifth transistor is determined to be turned on and off by a first sub-scanning signal, and the seventh transistor is determined to be turned on and off by a light emitting control signal.

6. The organic light emitting display device of claim 5, wherein the second scanning signal and the third scanning signal sequentially have periods of being in a state to turn on transistors connected to the second and third scanning signals, respectively during a period when the first scanning signal is in a state to turn on transistors connected to the first scanning signal.

7. The organic light emitting display device of claim 6, wherein the light emitting control signal is a version of another signal delayed by one horizontal period.

8. The organic light emitting display device of claim 7, wherein the other signal is the first sub-scanning signal.

9. The organic light emitting display device of claim 1, wherein the second transistor and the sixth transistor is determined to be turned on and off by a sub-light emitting control signal, the third transistor is determined to be turned on and off by a first scanning signal, the fourth transistor is determined to be turned on and off by a second scanning signal, and the fifth transistor and the seventh transistor are determined to be turned on and off by a light emitting control signal.

10. The organic light emitting display device of claim 9, wherein the second scanning signal and the first scanning signal are sequentially in a state to turn on transistors connected to the first and second scanning signals, respectively when the sub-light emitting control signal is in a state to turn on transistors connected to the sub-light emitting control signal.

11. The organic light emitting display device of claim 9, further comprising a third capacitor between the second node and the first pixel power supply.

12. A pixel comprising:

an organic light emitting diode configured to emit light according to a pixel electric current flowing from a first pixel power supply to a second pixel power supply;

a first transistor comprising a first electrode connected to the first pixel power supply, a second electrode connected to a first node, and a gate connected to a second node, wherein the pixel electric current flows from the first electrode to the second electrode, according to a voltage of the gate;

a second transistor configured to selectively supply a data signal to a third node;

a third transistor configured to selectively connect the second electrode of the first transistor with the gate of the first transistor;

a fourth transistor configured to selectively supply a voltage of an initialization power supply to the second node;

a fifth transistor configured to selectively supply a voltage of a first compensation power supply to the third node, wherein the first compensation power supply is different from each of the first pixel power supply, the second pixel power supply and the initialization power supply;

a sixth transistor configured to selectively supply a voltage to a fourth node;

a seventh transistor configured to selectively supply the pixel electric current to the organic light emitting diode;

a first capacitor connected to the second node and the fourth node; and a second capacitor connected to the third node and the fourth node, and wherein the second transistor and the sixth transistor are determined to be turned on and off by a first scanning signal, the third transistor is determined to be turned on and off by a second scanning signal, the fourth transistor is determined to be turned on and off by a third scanning signal, the fifth transistor is determined to be turned on and off by a first sub-scanning signal, and the seventh transistor is determined to be turned on and off by a light emitting control signal.

13. The pixel of claim 12, wherein the voltage of the first compensation power supply is substantially equal to the voltage of the first pixel power supply.

14. The pixel of claim 12, wherein the second scanning signal and the third scanning signal sequentially have periods of being in a state to turn on transistors connected to the second and third scanning signals, respectively during a period when the first scanning signal is in a state to turn on transistors connected to the first scanning signal.

15. The pixel of claim 14, wherein the light emitting control signal is a version of another signal delayed by one horizontal period.

16. The pixel of claim 15, wherein the other signal is the first sub-scanning signal.

17. An organic light emitting display device, comprising:

a pixel unit comprising a plurality of pixels circuits;

a data driving unit configured to supply a data signal to the pixel unit;

a power supply unit configured to supply a first pixel power, a second pixel power, a first compensation power, and a second compensation power to the pixel unit;

and a scanning driving unit configured to selectively supply the data signal, the first pixel power, the second pixel power, the first compensation power, and the second compensation power to the pixel unit such that pixel electric current corresponding to the data signal flows to the pixel, wherein each of the pixel circuits includes:

an organic light emitting diode configured to emit light according to a pixel electric current flowing from a first pixel power supply to a second pixel power supply;

a first transistor comprising a first electrode connected to the first pixel power supply, a second electrode connected to a first node, and a gate connected to a second node, wherein the pixel electric current flows from the first electrode to the second electrode, according to a voltage of the gate;

a second transistor configured to selectively supply a data signal to a third node;

a third transistor configured to selectively connect the second electrode of the first transistor with the gate of the first transistor;

a fourth transistor configured to selectively supply a voltage of an initialization power supply to the second node;

a fifth transistor configured to selectively supply a voltage of a first compensation power supply to the third node, wherein the first compensation power supply is different from each of the first pixel power supply, the second pixel power supply and the initialization power supply;

a sixth transistor configured to selectively supply a voltage to a fourth node;

a seventh transistor configured to selectively supply the pixel electric current to the organic light emitting diode;

a first capacitor connected to the second node and the fourth node; and a second capacitor connected to the third node and the fourth node, and wherein the second transistor and the sixth transistor are determined to be turned on and off by a first scanning signal, the third transistor is determined to be turned on and off by a second scanning signal, the fourth transistor is determined to be turned on and off by a third scanning signal, the fifth transistor is determined to be turned on and off by a first sub-scanning signal, and the seventh transistor is determined to be turned on and off by a light emitting control signal.

* * * * *

UNITED STATES PATENT AND TRADEMARK OFFICE

CERTIFICATE OF CORRECTION

PATENT NO. : 8,976,088 B2
APPLICATION NO. : 12/964435
DATED : March 10, 2015
INVENTOR(S) : Sam-II Han It is certified that error appears in the above-identified patent and that said Letters Patent is hereby corrected as shown below:

In the Specification,

Column 7, Line 4, please delete "N41" and insert therefore, --N41.--.

Column 8, Line 38, please delete "13" and insert therefore, --β--.

Column 14, Line 54, please delete "Enb" and insert therefore, --Enb.--.

Signed and Sealed this
Nineteenth Day of July, 2016

Michelle K. Lee

Michelle K. Lee
*Director of the United States Patent and Trademark Office*